United States Patent [19]

Compton

[11] 4,090,324

[45] May 23, 1978

[54] HOOP TOY ASSEMBLY

[76] Inventor: Sherman L. Compton, 4219 Berrybrook Dr., Richmond, Va. 23234

[21] Appl. No.: 802,849

[22] Filed: Jun. 2, 1977

[51] Int. Cl.[2] ..... A63H 33/02

[52] U.S. Cl. ..... 46/220

[58] Field of Search ..... 46/74 D, 75, 114, 220, 46/205

[56] References Cited

U.S. PATENT DOCUMENTS

| | | | |
|---|---|---|---|
| 104,150 | 6/1870 | Hessemer | 46/220 |
| 889,674 | 6/1908 | Fraser | 46/220 |
| 1,384,334 | 7/1921 | Pitoni | 46/114 |
| 2,984,937 | 5/1961 | Rendon | 46/220 |
| 3,708,911 | 1/1973 | Haschek | 46/220 |

*Primary Examiner*—Louis G. Mancene

*Assistant Examiner*—Mickey Yu

*Attorney, Agent, or Firm*—Norman B. Rainer

[57] ABSTRACT

A toy is provided comprising a circular tubular hoop member containing a removeable multi-spoked member. The spokes, which attach to a center hub, are cylindrical transparent tubes that confine liquid or solid material capable of movement within said tubes. The distal ends of the spokes have stubs which engage with the inside perimeter of the hoop. A hollow multi-lobed extension containing a confined species capable of movement is mounted on each side of the hub. When utilized as a toy for rolling on the ground, the spokes and multi-lobed extensions provide novel visual and audible effects. With the multi-spoked member removed, the hoop can be rotated horizontally about the user's body.

3 Claims, 5 Drawing Figures

HOOP TOY ASSEMBLY

BACKGROUND OF THE INVENTION

This invention relates to a manually operated hoop toy, and more particularly to a hoop toy having the dual capability of being utilized either as a visually and audibly appealing rolling hoop or as a hoop which the user can enter and cause to rotate in a substantially horizontal plane by suitable body movement.

Hoop toys adapted for rolling motion on the ground are generally well known. Specialized hoops which provide audible and/or visual effects responsive to the motion of the hoop are also known, one such embodiment being disclosed for example in U.S. Pat. No. 3,676,951.

Hoops especially adapted for rotational use about the user's body generally require critical dimensional and weight characteristics, as disclosed in U.S. Pat. No. 3,079,728. Such hoops must be rigid and of light weight, and must have a large enough diameter to gyrate about the user's torso.

It is an object of the present invention to provide a hoop toy which can be utilized either as a rolling hoop which provides audible and visual effects, or as a hoop for rotation about the user's body. It is another object to provide a hoop toy assembly of low cost capable of rapid interconversion from one mode to another. These objects and other objects and advantages of the invention will be apparent from the following description.

SUMMARY OF THE INVENTION

The above and other beneficial objects and advantages are accomplished in general by providing a hoop toy assembly comprising a rigid tubular hoop member having the form of a closed circular hoop, and a multi-spoked member adapted for removeable insertion within said tubular member. The tubular member has an interior perimeter disposed toward the center of said hoop, and an exterior perimeter opposed to said interior perimeter and coplanar therewith. The diameter of the interior perimeter is preferably between about 30 and 40 inches. The diameter of the tubular member itself, or the distance between said interior and exterior perimeters is perferably between about 0.75 and 1.0 inch.

The weight of the tubular member is preferably between about 5 and 13 ounces. The weight and linear dimensions of the hoop are selected so that the hoop may be caused to rotate about the body of a user for relatively long periods of time by co-ordinated movement of the body of the user. The interior perimeter of the tubular member is provided with a series of uniformly spaced depressions.

The multi-spoked member is comprised of a plurality of co-planar elongated cylindrical tube spokes of equal length attached at their proximal ends to a hub adapted to be centered within said hoop. The opposite, distal ends of said spokes define a circular locus. Each distal end is provided with a stub adapted to fit snugly into the depressions within the interior perimeter of the hoop. The multi-spoked member possesses sufficient flexibility so that it can be deformed when desired for engagement and disengagement with respect to the hoop. Each spoke is transparent and contains confined solid or liquid species which will undergo gravity-induced motion in response to rolling action of the hoop toy assembly. Such motion of the confined species is intended to provide a visual and/or audible effect.

Mounted equidistantly on each side of the hub are hollow multi-lobed extensions which confine solid species capable of providing a visual and/or audible effect distinct from the effect produced by said spokes.

BRIEF DESCRIPTION OF THE DRAWING

In the accompanying drawing forming a part of this specification and in which similar numerals of reference indicate corresponding parts in all the figures of the drawing.

DETAILED DESCRIPTION OF THE INVENTION

Figure 4:
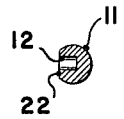
FIG. 4 is an enlarged sectional view taken along the line 4—4 of FIG. 1.
Figure 3:
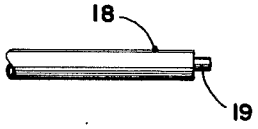
FIG. 3 is an enlarged fragmentary view of the distal end of one of the spoke members shown in FIG. 1.
Figure 5:
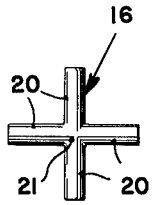
FIG. 5 is an enlarged front plan view of the multi-lobed extension of FIG. 1.
Figure 1:
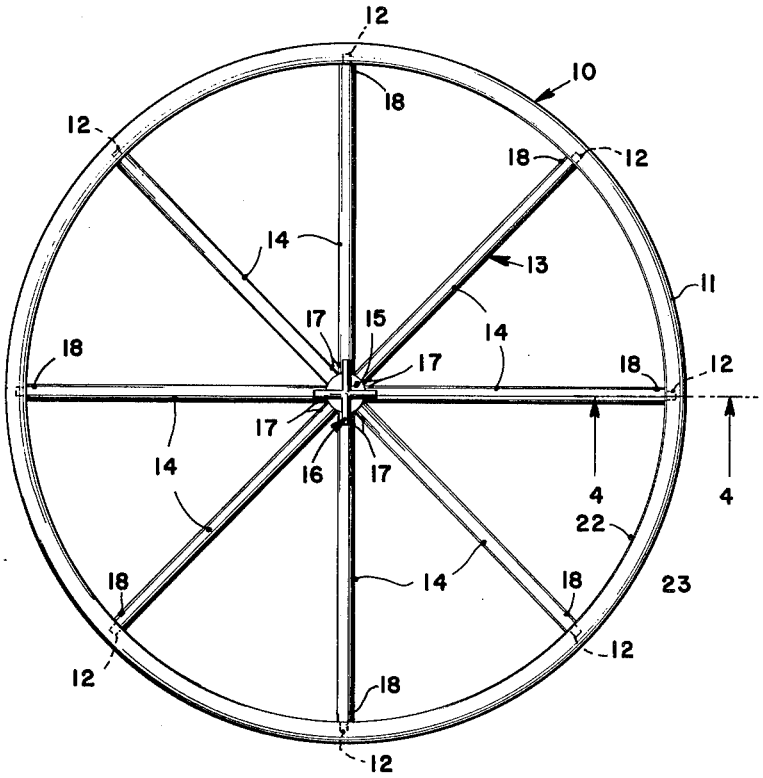
FIG. 1 is a front plan view of an embodiment of the hoop toy assembly of the present invention.
Figure 2:
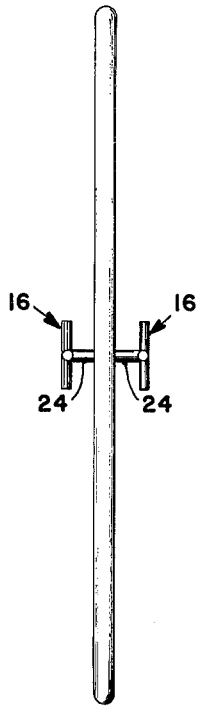
FIG. 2 is an end view of the hoop toy assembly of FIG. 1.

Referring to FIG. 1, the hoop toy assembly 10 is shown to consist of tubular hoop member 11 containing uniformly spaced depressions 12 in the inside perimeter 22, and multi-spoked member 13 comprised of spokes 14, a central disc 15 to which the proximal ends 17 of said spokes attach, and multi-lobed extensions 16 attached to central disc 15 by standards 24, shown more clearly in FIG. 2.

The distal end 18 of each spoke is provided with a stub 19 having a cross-sectional area, taken in the plane perpendicular to the longitudinal axis of the spoke, smaller than the similarly taken cross sectional area of the body of the spoke 14, and having a cross-sectional configuration which may be circular, polygonal, or multi-lobed. The stub may have a length of between about 0.25 to 0.5 inch in the direction of the spoke axis, and may be an integral continuous extension of the spoke, or attached as a separate member.

The spokes 14, hoop 11 and multi-lobed extensions are fabricated of rigid thermoplastic polymeric material such as polyolefin, polystyrene, polycarbonate, polyurethane, polyamide, polyester, polyether, cellulosic esters, and copolymers derived from acrylic esters, acrylonitrile, vinyl chloride and butadine. The polymeric material is preferably chosen so as to permit fabrication of the afore-mentioned members by extrusion or injection molding techniques. Because the spokes and multi-lobed extensions are sufficiently transparent to reveal material confined therein, selection of a thermoplastic polymer for their fabrication is constrained to compositions generally having transparent characteristics.

Attachment of the proximal ends of the spokes to the hub may be achieved by adhesive bonding or by thermal or solvent bonding, depending upon the material of construction of the hub, and manufacturing expediency. The hub may be fabricated of any rigid, dimensionally stable material such as wood, plastic, metal, and composite structures thereof. Although the hub has been exemplified as a flat circular disc in the drawings, other structural embodiments having equivalent function may be employed.

For proper effect, five to eight spokes are employed in the hoop toy assembly, symmetrically spaced about the hub and adapted for engagement with the hoop member. Fewer than five spokes do not provide adequate visual effect, and more than eight spokes increases the expense of the toy without attendant improvement in visual effectiveness.

The multi-lobed extensions 16 are spaced between 0.5 and 3 inches from the hub. Although the specific embodiment of multi-lobed extension exemplified in the drawing has four equal lobes 20 arranged 90° apart, other numbers of lobes arranged in different angular disposition may be employed. The interiors of the separate lobes intercommunicate at their intersection 21 so that material such as beads, beans, granules or the like confined within the lobes may travel from one lobe to another. This manner of motion of the confined material is different than the motion of the confined material in the spokes, wherein said material can only travel back and forth within each spoke.

The length of each lobe 20, measured from the communal intersection 21, may range from 1.0 to 3.0 inches. The cross sectional configuration of each lobe, taken in a plane perpendicular to the longitudinal axis of the lobe, is preferably circular, as shown in the drawings. Other alternative configurations are suitable, based upon various cylindric and prismatic shaped lobes. Said cross section of the lobes may have an inside dimension ranging from 0.25 to 0.75 inch. Both multi-lobed members are identical and are mounted preferably in aligned opposed relationship.

The hoop member is a toroidal shape formed by the joining of the ends of a cylindric or prismatic surface in a circular path. The transverse section of the hoop may be circular, eliptical or of other configuration.

The hoop member contains within its inside perimeter 22 depressions 12 which are integral and continuous with the hoop and contoured to accommodate stubs 19 at the distal ends of the spokes. The inside perimeter 22 may be a flattened region, as in the illustrated embodiment, or may be rounded in conformance with the remainder of the hoop. In preferred embodiments, the inside perimeter 22 will also be provided with frictional characteristics, the purpose of which is to minimize the tendency of the hoop to slide down the user's body. The frictional characteristics may consist of a series of continuous parallel grooves imparted during the extrusion formation of the tubular material from which the hoop is made. Alternatively, frictional characteristics may be imparted by knurling, cutting or sanding techniques, by application of abrasive particles to one side of the freshly extruded, still hot tubular material, and by other methods.

The hoop is preferably made from an extruded tube of 0.050 to 0.070 wall thickness which is formed into a closed loop and joined by a plug inserted into the abutting end portions, or joined by other means such as heat bonding or the like. When employed as an exercise toy, the gyrations of the user's body impart centrifugal force to the hoop, causing it to overcome downward gravitational force and rotate in a substantially horizontal plane. Securement of the desired effect requires that the hoop be rigid, light in weight, of proper diameter, and capable of frictional affinity toward the user.

When the hoop toy assembly of this invention is utilized as a rolling toy with the spoke assembly in place, it may be propelled, and controlled by means of a suitable cane or hooked stick.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

Having thus described my invention, what is claimed is:

1. A hoop toy assembly comprising:

a. A rigid hoop member fabricated from a tube bent into a circular shape and closed at both ends to form a continuous loop, said loop having an inside perimeter disposed toward the center of said loop and provided with a plurality of uniformly spaced depressions directed into said tube and integral therewith, the diameter of said inside perimeter being between 30 and 40 inches, the transverse section of said tube being uniform throughout the length thereof and having a maximum dimension between about 0.75 and 1.0 inch, said hoop having a weight between 5 and 13 ounces, b. a multi-spoked member comprised of a plurality of elongated transparent cylindrical tube spokes of equal length attached at their proximal ends to a hub, the distal ends of said spokes defining a circular locus and each being provided with a stub adapted to fit snugly within said depressions, each spoke containing confined solid or liquid species capable of undergoing gravity-induced motion in response to rolling action of the hoop toy assembly, said multi-spoked member possessing sufficient flexibility so that it can be deformed when desired for engagement and disengagement with respect to said hoop, and c. a pair of multi-lobed extensions mounted equidistantly on each side of said hub, and comprised of elongated hollow lobes containing solid or liquid species confined in a manner such that rolling motion of said hoop toy assembly will cause said confined species to travel from one lobe to another.

2. The hoop toy assembly of claim 1 wherein said hoop, spokes and multi-lobed extensions are fabricated from a thermoplastic polymer composition.

3. The hoop toy assembly of claim 1, wherein multi-lobed extensions are identical and mounted in opposed, aligned juxtaposition.

* * * * *